US005540896A

United States Patent [19]

Newby

[11] Patent Number: 5,540,896

[45] Date of Patent: Jul. 30, 1996

[54] SYSTEM AND METHOD FOR CLEANING HOT FUEL GAS

[75] Inventor: Richard A. Newby, Pittsburgh, Pa.

[73] Assignee: Westinghouse Electric Corporation, Pittsburgh, Pa.

[21] Appl. No.: 54,986

[22] Filed: Apr. 30, 1993

[51] Int. Cl.[6] ..... B01D 50/00

[52] U.S. Cl. ..... 422/172; 422/178; 423/230; 423/231

[58] Field of Search ..... 422/168, 171, 422/172, 178; 423/230, 231

[56] References Cited

U.S. PATENT DOCUMENTS

| | | | |
|---|---|---|---|
| 4,251,495 | 2/1981 | Deschamps et al. | 423/230 |
| 4,343,631 | 8/1982 | Ciliberti | 55/302 |
| 4,539,025 | 9/1985 | Ciliberti et al. | 55/302 |
| 4,553,986 | 11/1985 | Ciliberti et al. | 55/68 |
| 4,735,635 | 4/1988 | Israelson et al. | 55/71 |
| 4,735,638 | 4/1988 | Ciliberti | 55/302 |
| 4,737,176 | 4/1988 | Lippert | 55/480 |
| 4,764,190 | 8/1988 | Israelson et al. | 55/269 |
| 4,812,149 | 3/1989 | Griffin et al. | 55/71 |
| 4,927,430 | 5/1990 | Calderon | 48/197 |
| 4,973,458 | 11/1990 | Newby et al. | 423/244 |
| 5,143,530 | 9/1992 | Haldipur | 55/3411 |
| 5,176,088 | 1/1993 | Amrhein et al. | 422/172 |

FOREIGN PATENT DOCUMENTS

| | | |
|---|---|---|
| 2368989 | 5/1978 | France . |
| 2432887 | 3/1980 | France . |
| 2106532 | 4/1983 | United Kingdom . |

OTHER PUBLICATIONS

Development of Hot Gas Cleaning Systems for Advanced, Coal–Based Gas Turbine Cycles, (Lippert et al.), Jul. 1993, Journal of Engineering for Gas Turbines & Power, pp. 658–664.

ASME Paper, Oct. 18, 1992, Development of a Direct Coal–Fired Advanced Combined Cycle Concept for Repowering and New Base Load Generation, (Jensen et al.).

S. Soung, et al., KRW High Temperature Coal Gas Desulfurization, Presented at the First Int. Conf. on Separation Science and Technology, Apr. 1986.

M. G. Klett, et al., Conceptual Designs of Advanced High–Temperature Desulfurization Processes, vol. II, Dec. 1986 (NTIS No. DOE/MC/21098–2248–vol. 2).

Southern Company Services, Inc., Assessment of Coal Gasification/Hot Gas Cleanup Based Advanced Gas Turbine Systems, Final Report, Dec. 1990 (NTIS No. DOE/MC/26019–3004).

Proceedings of the Eleventh Annual Gasification and Gas Stream Cleanup Systems Contractors Review Meeting, Aug. 1991 NTIS No. DOE/METC–91/6123, vol. 1 and vol. 2).

*Primary Examiner*—Timothy M. McMahon

[57] ABSTRACT

A hot gas cleanup system for removing particulates, alkali and sulfur from fuel gas produced by the gasification of coal in a gasifier, especially in an integrated gas turbine gasification power plant. A calcium based sulfur sorbent and an alkali sorbent are injected directly into the fuel gas and then recovered, along with the used sorbent, in a high efficiency, high temperature ceramic barrier filter. The fuel gas is then subjected to further de-sulfurization in a polishing de-sulfurizer supplied with a copper based sulfur sorbent. The used copper based sorbent is regenerated in fluidized bed regenerator. The regenerated sorbent is returned to the polishing de-sulfurizer and sulfur dioxide produced by the regeneration is directed to an oxidizer to which the used and unused sulfur sorbent from the filter is supplied so that the sulfur dioxide can be captured and so that the used sulfur sorbent can be converted to a more stable form for disposal.

10 Claims, 5 Drawing Sheets

SYSTEM AND METHOD FOR CLEANING HOT FUEL GAS

BACKGROUND OF THE INVENTION

The present invention relates to a system and method for cleaning a hot coal-derived fuel gas. More specifically, the present invention relates to a hot gas cleanup system and a method for removing particulates, sulfur and alkali species from high temperature, high pressure coal-derived fuel gas in an integrated combined cycle coal gasification power plant or in a direct coal-fired gas turbine power plant.

The high efficiency, low capital cost and short lead time of gas turbine based power plants make them particularly attractive to electric utilities as a means of producing electrical power. Unfortunately, traditionally, gas turbines have been limited to operation on expensive, sometimes scarce, fuels—chiefly, distillate oil and natural gas. As a result of the ready availability and low cost of coal, considerable effort has been expended toward developing a gas turbine system for generating electrical power that can utilize coal as its primary fuel.

Two such approaches have been developed. In one approach, referred to as an integrated combined cycle coal gasification power plant, steam and compressed air from the gas turbine compressor, or compressed oxygen, is used to partially combust coal in a gasifier to produce a low to medium heating value fuel gas. In the second approach, coal is directly gasified in compressed air from the compressor, producing a low heating value fuel gas. In either approach, a high temperature, high pressure gas is produced that must then be expanded in the turbine section of the gas turbine. Since the gas contains particulate matter, as well as sulfur and alkali species, all of which can be harmful to the turbine components, it is important that the gas be cleaned prior to expansion in the turbine. The cleaned gas should also satisfy environmental emission standards.

Traditionally, fuel gas cleanup systems operate at near ambient temperature and require large heat exchanger equipment to cool the hot fuel gas prior to cleaning. Such low temperature gas cleaning is expensive and reduces the power plant efficiency. While high temperature cleanup systems have been proposed that utilize ceramic barrier filter technology to remove particulates and zinc-based sorbents to remove sulfur, such systems have a high capital cost and are expensive to operate. The operating temperature of the zinc-based sorbents is limited so that large heat exchanger equipment is still required. In addition, the cost of zinc-based sorbents is high and sorbent losses due to physical and chemical attrition are great and has a significant negative impact on operating cost.

It is therefore desirable to provide a hot fuel gas cleanup system that is capable of operating on high temperature, high pressure fuel gas and in which the use of expensive sorbents is minimized, thereby making the system economical to operate.

SUMMARY OF THE INVENTION

Accordingly, it is the general object of the current invention to provide a hot fuel gas cleanup system that is capable of operating on high temperature; high pressure fuel gas and in which the use of expensive sorbents is minimized, thereby making the system economical to operate.

Briefly, this object, as well as other objects of the current invention, is accomplished in a system for removing sulfur species from a hot coal-derived gas, comprising (i) first means for bringing a first sulfur sorbent into contact with the gas, thereby removing a first portion of the sulfur species from the gas by converting the first sorbent into a first sulfur compound, (ii) a first filter connected to receive the gas from the first sorbent contact means, the first filter having means for removing from the gas at least a portion of the first sorbent and the first sulfur compound, (iii) second means for bringing a second sulfur sorbent into contact with the gas and for entraining at least a portion of the second sorbent therein, thereby removing a second portion of the sulfur species from the gas and producing a second sulfur compound, the second sorbent contact means connected to receive the gas from the first filter, and (iv) a regenerator having means for regenerating the second sulfur compound so as to produce the second sulfur sorbent and a sulfurous gas, the regenerator connected to receive the second sulfur compound from the second sorbent contact means and connected to discharge the regenerated second sulfur sorbent thereto.

In one embodiment of the invention, the first sorbent contact means comprises an injector for injecting particles of the first sorbent into the gas. The system further comprises means for converting the first sulfur compound into a third sulfur compound that is more stable than the first sulfur compound and for converting the sulfurous gas into a solid sulfur compound. The converting means is connected to receive the first sulfur compound from the first filter and connected to receive the sulfurous gas from the regenerator.

The current invention also encompasses a method of removing sulfur species from a hot coal-derived gas, comprising the steps of (i) bringing a first sulfur sorbent into contact with the gas so as to remove a first portion of the sulfur species from the gas by converting the first sorbent into a first sulfur compound, at least portions of the first sorbent and the first sulfur compound being entrained in the gas, (ii) removing at least a portion of the entrained first sorbent and the entrained first sulfur compound from the gas, (iii) bringing a second sulfur sorbent into contact with the gas so as to remove a second portion of the sulfur species from the gas by converting the second sorbent into a second sulfur compound, at least portions of the second sorbent and the second sulfur compound being entrained in the gas, and (iv) regenerating at least a portion of the second sulfur compound brought into contact with the gas in a regenerator so as to produce the second sulfur sorbent and a sulfurous gas.

DESCRIPTION OF THE PREFERRED EMBODIMENT

Figure 1:
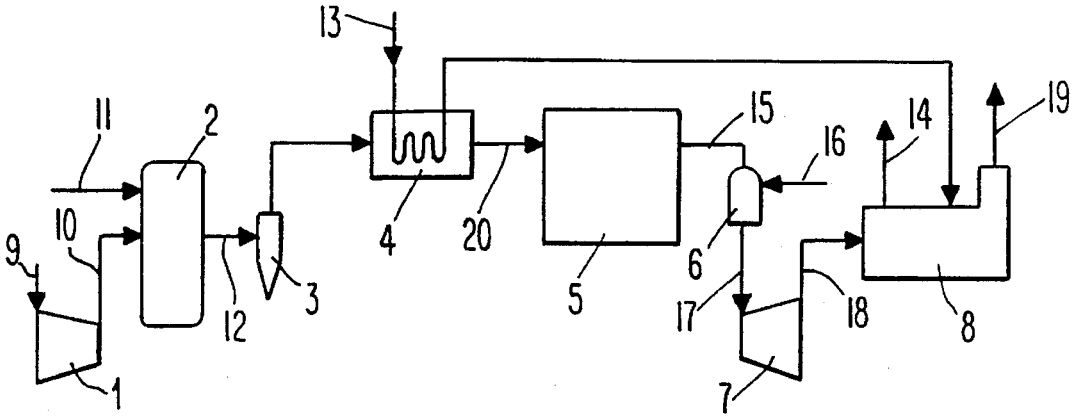
FIG. 1 is a schematic diagram of an integrated coal gasification gas turbine power plant using the hot gas cleanup system of the current invention.

Referring to the drawings, there is shown in FIG. 1 a schematic diagram of an integrated coal gasification gas turbine power plant. The plant comprises a compressor 1 that inducts ambient air 9 and produces high pressure air 10 that is used to gasify coal 11 in a gasifier 2. The gasifier produces a fuel gas 12 that may have a temperature and pressure as high as 1650° C. (3000° F.) and 2760 kPa(400 psia), respectively, and that is laden with particulates, chiefly coal slag and ash, as well as sulfur species, chiefly hydrogen sulfide and COS, and alkali species. The fuel gas 12 is passed through a cyclone separator 3 in which a portion of the particulate matter is removed. The fuel gas then flows through a heat exchanger 4 supplied with feedwater or steam 13 and in which the temperature of the fuel gas is reduced to approximately 925° C. (1700° F.)

The fuel gas 20 from the heat exchanger 4 is then processed in the gas cleanup system 5 according to the current invention. The clean gas 15 is combusted in a combustor 6, into which a supplemental fuel—such as oil or natural gas—may be added and the hot gas expanded in a turbine 7. The expanded gas 18 from the turbine 7 flows through a heat recovery steam generator 8, supplied with heated feedwater or steam from the heat exchanger 4, and the gas 19 is then exhausted to atmosphere.

Figure 2:
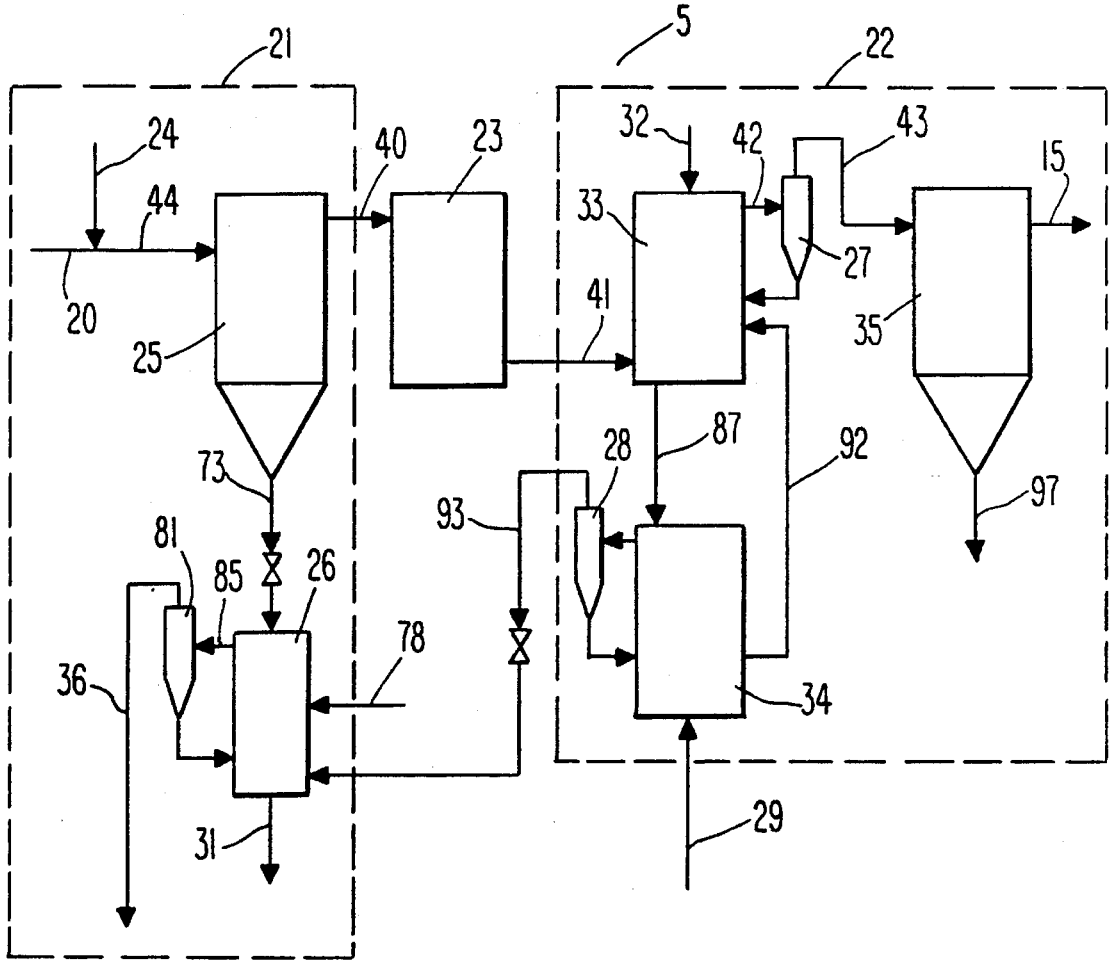
FIG. 2 is a schematic diagram of the hot gas cleanup system shown in FIG. 1.

The gas cleanup system according to the current invention is shown in an overall fashion in FIG. 2. The system has three major subsystems—a primary sulfur removal and oxidizer subsystem 21, a polishing sulfur removal and regenerator system 22, and an alkali removal unit 23. A primary sulfur sorbent 24 is injected into the fuel gas 20 upstream of a primary filter 25, thereby removing a substantial portion of the sulfur from the fuel gas. The sorbent laden fuel gas 44 then flows through the primary filter 25, wherein a substantial portion 73 of the used and unused primary sorbent is removed and directed to an oxidizer 26. The filtered fuel gas 40 is then directed to the alkali removal unit 23, containing a fixed alkali sorbent bed, wherein a substantial portion of the alkali species is removed from the fuel gas.

From the alkali removal unit 23, the fuel gas 41 is directed to a polishing de-sulfurizer 33, in which a polishing sulfur sorbent in maintained in a bed fluidized by the fuel gas 41. The polishing de-sulfurizer 33 removes a substantial portion of the sulfur remaining in the fuel gas and discharges the fuel gas 42 to a cyclone separator for particulate removal. The fuel gas 43 then flows through a secondary filter 35 and the clean gas is discharged from the system. The solids 97 captured by the filter, which includes used and unused sorbent, are then removed for reprocessing, which may include regeneration, as discussed further below.

As shown in FIG. 2, the used polishing sorbent 87 from the polishing de-sulfurizer 33 is directed to a regenerator 34 into which air 29 is drawn to fluidize a bed of the used sorbent, thereby producing regenerated polishing sorbent 92 that is recycled to the polishing de-sulfurizer 33. The regeneration also produces sulfur dioxide, which is directed, via a cyclone separator 28, to the oxidizer 26. In the oxidizer 26, the used and unused primary sorbent 73 is maintained in a bed fluidized by the sulfur dioxide rich gas stream 93 from the regenerator 34 and by air 78. This results in the used primary sorbent being converted to a more stable compound for waste disposal 31. After particle removal in a cyclone separator 81, the gas 36 from the oxidizer 26 is discharged to a stack (not shown). The various components of the system and the reactions that occur in these components are discussed in more detail below.

Figure 3:
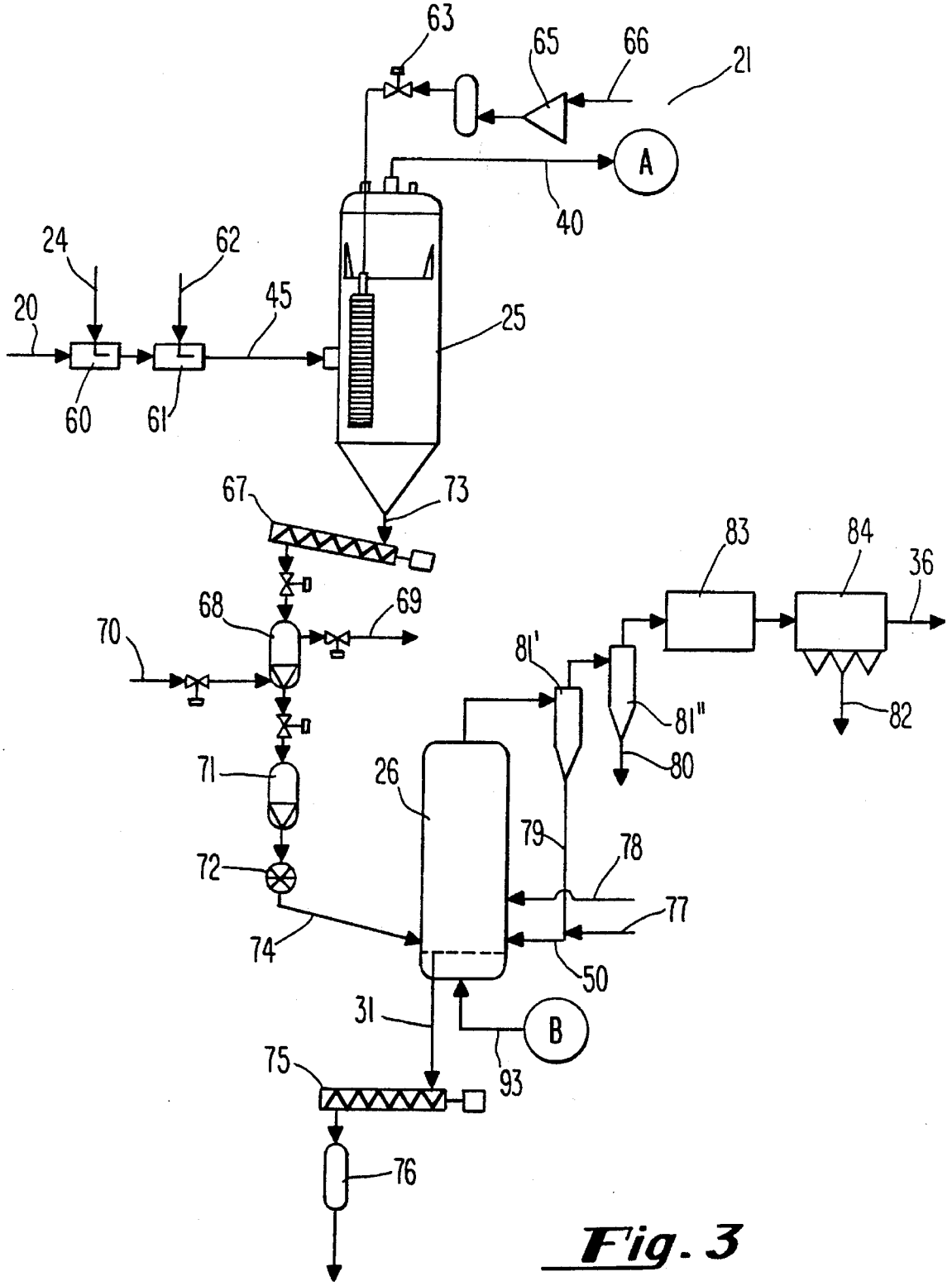
FIG. 3 is a more detailed schematic of the primary filter and oxidizer portion of the system shown in FIG. 2.

As shown in FIG. 3, in the preferred embodiment, the primary sulfur sorbent 24 is injected as relatively fine particles directly into the fuel gas 20 upstream of the primary filter 25 by means of an injector 60. Preferably, the sorbent 24 is calcium based, such as calcitic limestone or dolomitic limestone, that removes sulfur by forming a sulfur compound—i.e, CaS—referred to as "used" sorbent. Accordingly, the significant reaction is:

$$CaCO_3+H_2S=CaS+H_2O+CO_2.$$

However, hydrated lime could also be used, in which case the significant reactions are:

$$Ca(OH_2)=CaO+H_2O$$

$$CaO+H_2S/CO_2=CaS/CaCO_3.$$

Preferably, the rate at which the sorbent 24 is injected is sufficient to maintain the calcium/sulfur feed ratio at approximately 2.0, by atomic ratio.

As discussed below, excess, unused calcium based sorbent removed by the primary filter 25 is used to capture sulfur dioxide gas, produced by the regeneration of a copper based sorbent in the polishing de-sulfurizer 33, by fluidizing this excess sorbent in the oxidizer 6. Accordingly, the size of the sorbent 24 particles should be sufficiently small to be readily fluidizable. In the preferred embodiment, calcitic limestone sorbent particles of −70 mesh (i.e., less than about 250 μm in diameter) are used. Preferably, these particles have a mass-mean diameter of about 50 μm and a surface-mean diameter of about 20 μm. Use of such small diameter particles, made possible by the high performance of the primary filter, as discussed further below, improves the efficiency of the de-sulfurization process.

As previously discussed, in the preferred embodiment of the invention, careful attention is given to the removal of harmful alkali vapors—chiefly sodium and potassium species, primarily in the form of chlorides and hydrates—from the fuel gas. Accordingly, as shown in FIG. 3, particles of an alkali sorbent 62 are also injected, via an injector 61, directly into the fuel gas 20 upstream of the primary filter 25. In the preferred embodiment, the alkali sorbent 62 is emathlite sorbent that has been pulverized to 80% −325 mesh size.

Figure 8:
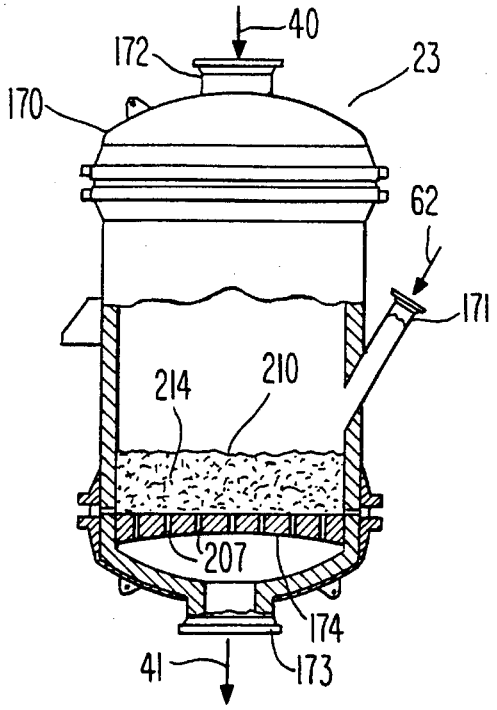
FIG. 8 is partial cross-section of the alkali removal vessel shown in FIG. 2.

As previously discussed, in addition to, or alternatively to, the injection of alkali sorbent 62 directly into the fuel gas, alkali removal could also be accomplished by flowing the fuel gas 40 from the primary filter 25 through an alkali removal unit 23, as shown in FIG. 2. In the preferred embodiment, the alkali removal unit 23 comprises a vessel 170 enclosing a packed bed 210 of emathlite pellets 214 supported on a distribution plate 174, as shown in FIG. 8. Preferably, the distribution plate 174 is formed from a ceramic material and has a quantity of holes 207 formed therein so as to create sufficient pressure drop to maintain a uniform gas flow through-the bed 210. The vessel 170 includes a gas inlet 172, a gas outlet 173, and a solids inlet 171.

Figure 5:
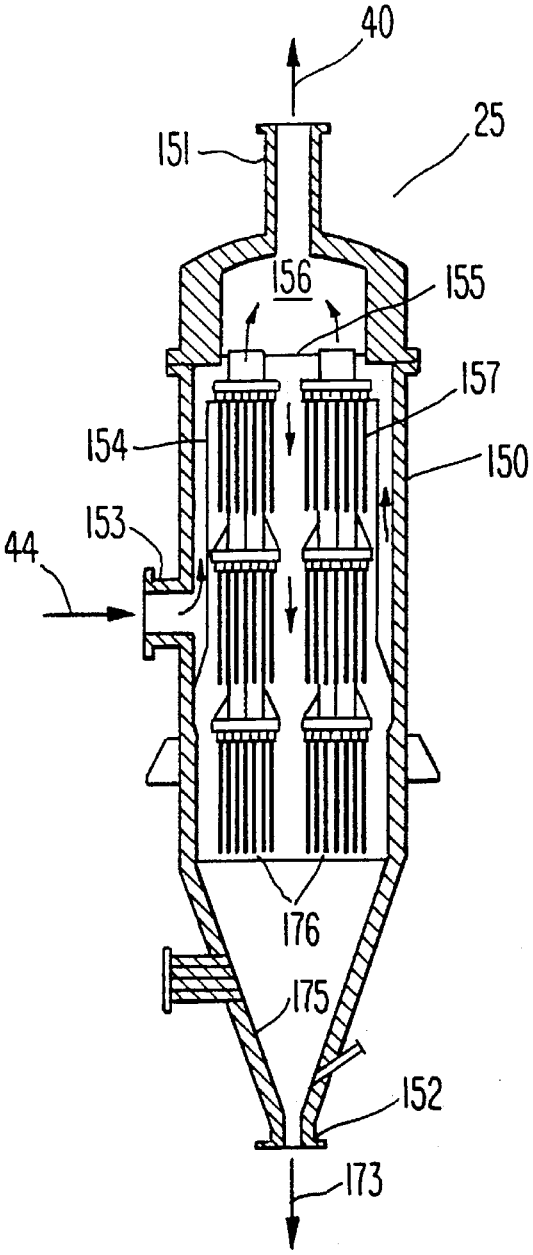
FIG. 5 is a cross-section through the primary filter shown in FIG. 2.
Figure 6:
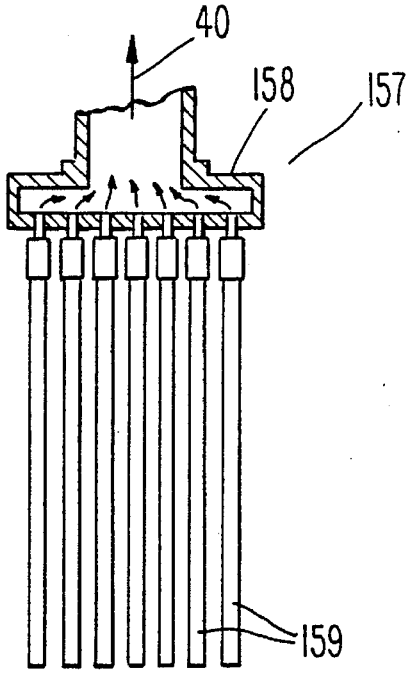
FIG. 6 is a detailed view of a candle array of the primary filter shown in FIG. 5.
Figure 7:
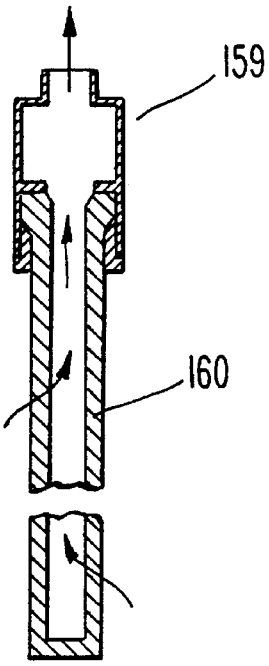
FIG. 7 is a detailed view of one of the candles in the candle array shown in FIG. 6.

After injection of the sulfur and alkali sorbents, the fuel gas 45 flows through the primary filter 25, as shown in FIG. 3. As shown in FIG. 5, in the preferred embodiment of the current invention, the primary filter 25 comprises a vessel 150 that is lined with refractory material 175 and in which multiple filter columns 176 are disposed. Each filter column 176 is formed by three candle arrays 157 supported on a support structure 155, which includes a high alloy tube sheet and an expansion assembly. As shown in FIG. 6, each candle array 157 is comprised of multiple candles 159 connected to a common plenum 158. As shown in FIG. 7, each candle is comprised of a hollow ceramic tube 160 having porous walls into which gas may flow, leaving particulate matter as a filter cake formed on the exterior surfaces of the tube 160.

In the preferred embodiment, a pulse-type cleaning system is incorporated into the primary filter 25. This cleaning is accomplished by connecting the output of a pulse compressor 65 to the candle plenums 158 by means of a pulse control valve 63, as shown in FIG. 3. The compressor 65 directs pulses of a gas 66, such as nitrogen or fuel gas, into the hollow portions of the candles 160 to prevent excessive buildup of the filter cake on the exterior surfaces of the candles.

Returning to FIG. 5, the primary filter vessel 157 has a gas inlet 153 into which the sorbent laden fuel gas 44 is directed. Upon entering the vessel 157, the fuel gas 44 is directed by a liner 154 to flow upward within an annular passage formed between the vessel and the liner. The fuel gas 44 then flows downward and into the candles 160 within each array 157. The cleaned fuel gas 40 flows from the candle array plenums 158 into a common plenum 156 and then discharges through a gas outlet 151. A solids outlet 152 at the bottom of the vessel 150 allows the particles removed from the fuel gas to be discharged from the vessel. These particles include unused and used primary sulfur sorbent—i.e., in the preferred embodiment, limestone ($CaCO_3$) and calcium sulfide (CaS).

Candle-type ceramic barrier filters of the general type discussed above are disclosed in U.S. Pat. Nos. 4,973,458 (Newby et al.), 4,812,149 (Griffin et al.), 4,764,190 (Israelson et al.), 4,735,635 (Israelson et al.) and 4,539,025 (Ciliberti et al.), each of which is incorporated herein in its entirety by reference. However, the invention could also be practices using other types of high performance, high temperature filters, such as bag filter elements—see, for example, U.S. Pat. No. 4,553,986 (Ciliberti et al.), incorporated herein in its entirety by reference—or a cross-flow type filter.

The solids 73 (i.e., $CaCO_3$ and CaS) removed from the primary filter 25 are transferred, via a screw conveyor 67, to a lock hopper 68 pressurized by a gas 70 and from which gas 69 is vented. From the lock hopper 68, the de-pressurized solids 74 are collected in a hopper 71 and then directed, via a rotary feed 72, to the oxidizer 26 for capture of sulfur dioxide produced during the regeneration of polishing sorbent, as discussed further below.

Figure 4:
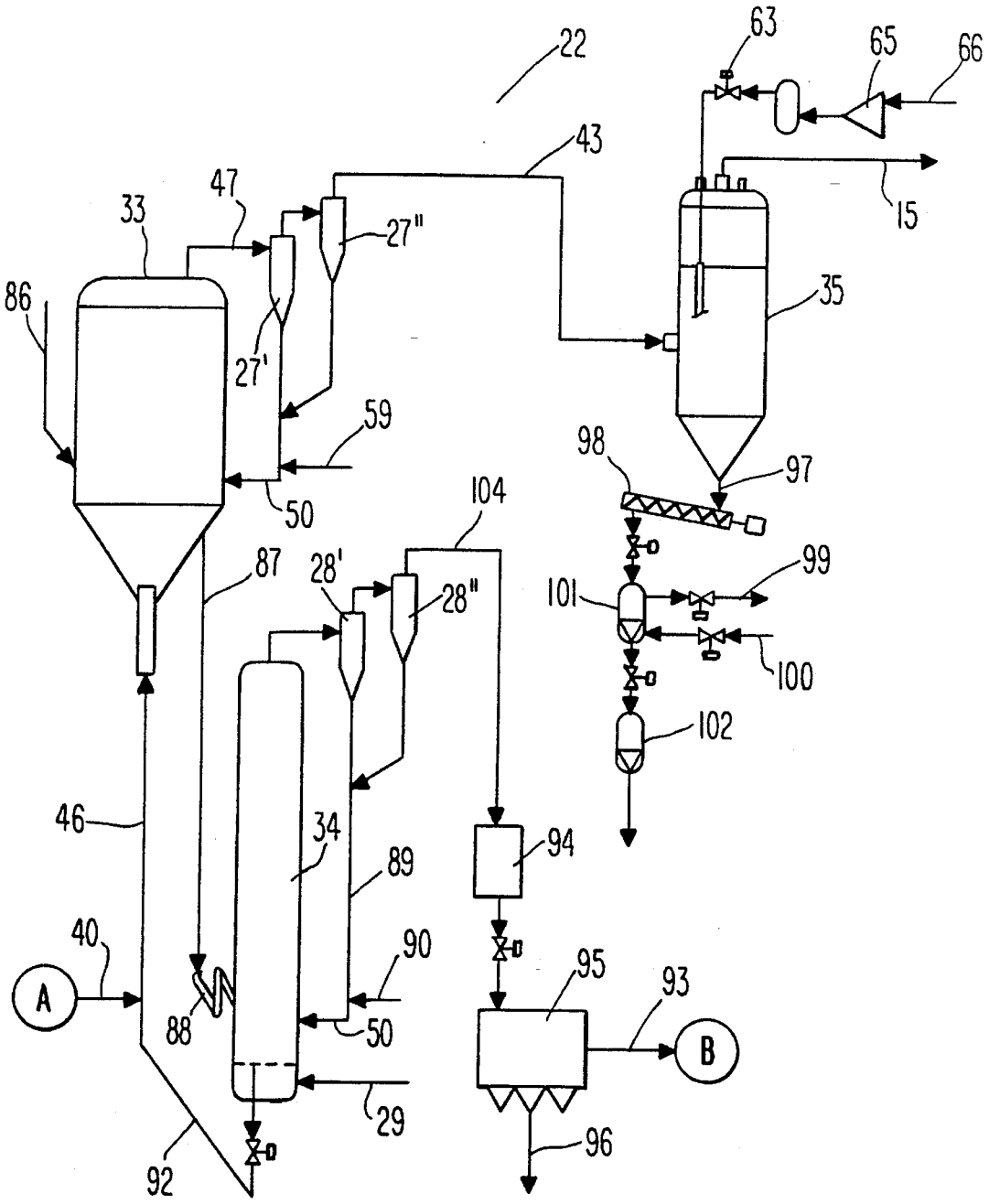
FIG. 4 is a more detailed schematic of the sulfur polishing unit, secondary filter and sorbent regenerator portion of the system shown in FIG. 2.
Figure 9:
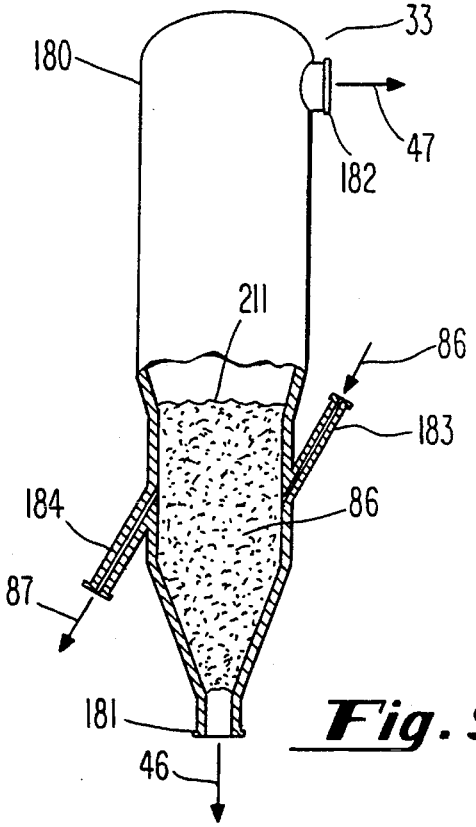
FIG. 9 is partial cross-section of the sulfur polishing vessel shown in FIG. 2.

After flowing through the primary filter 25 and, if one is provided, the alkali removal unit 23, the fuel gas 40 then flows into the polishing de-sulfurizer 33, as shown in FIGS. 2 and 4. As shown in FIG. 9, the polishing desulfurizer 33 comprises a vessel 180 enclosing a fluidized bed 211 of a sulfur sorbent 86 fluidized by the fuel gas 40. Under normal operating conditions, the bed is maintained at a temperature of approximately 870° C. (1600° F.) and a pressure of approximately 1585 kPa (230 psia). The vessel 180 has an inlet 181 for receiving a mixture 46 of the fuel gas 40 and particles of polishing sorbent 92 that have been regenerated, as discussed below, a solids inlet 183 by which fresh polishing sorbent feed 86 is introduced, a gas outlet 47 for discharging the de-sulfurized gas 47, and a solids outlet 184 for discharging used polishing sorbent 87 to the regenerator 34.

As shown in FIG. 4, polishing sulfur sorbent 92, regenerated as discussed below, is transported vertically upward by the fuel gas 40 stream into the vessel 180, creating a "jetting" fluidized bed 211. This allows the desulfurization reactions to begin during initial entrainment of the polishing sorbent 92 and provides intensive mixing of the sorbent 92 particles within the "jet" that prevents the highly exothermic reactions from creating excessive temperatures in the sorbent. Fresh polishing sorbent 86 is added to the vessel 180 as necessary to make up for sorbent losses. The fuel gas 47 discharged from the vessel 180 passes through a pair of cyclone separators 27' and 27" in which entrained sorbent particles are captured and returned to the vessel via an L-valve 50 into which a pressurized gas 59, such as nitrogen or fuel gas, is introduced.

In the preferred embodiment, the polishing sulfur sorbent 86 is a copper based sorbent. However, zinc based, iron based and manganese based sorbents could also be utilized. Preferably, the sorbent is copper oxide, 10% weight copper, supported as a coating on porous alumina particles that have been crushed to a −35 mesh size (i.e., less that 500 μm). As with the calcium based sorbent, the particle size is selected to ensure good fluidization in the bed 211. Alternatively, a mixture of copper oxide particles and inert silica or alumina particles may be used. The major reactions are the reduction of copper oxide to copper metal and the sulfidation of the copper so as to produce a sulfur compound:

$$CuO+H_2/CO=Cu+H_2O/CO_2$$

$$2\ CU+H_2S=Cu_2S+H_2.$$

The use of relatively inexpensive calcium sorbent 24 for the bulk of the primary de-sulfurization allows more economical use of the more expensive copper based sorbent 86 in the second de-sulfurization stage. In addition, regeneration of the used copper sorbent, as discussed below, further reduces sorbent costs. Moreover, the use of sorbent particles having such small diameters, as compared to current practice, wherein pellets having diameters of up to 1.2 cm (0.5 inch) are used, results in improved sulfurization, regeneration and durability.

From the polishing de-sulfurizer 33, the fuel gas 43 is directed to the secondary filter 35 in which particulates are removed. In the preferred embodiment, the secondary filter 35 is of the ceramic barrier type and may of identical design to the primary filter 25. The solids 97 removed from the filter are transferred, via a screw conveyor 98, to lock hopper 101 pressurized by a gas 100 and from which gas 99 is vented. As a result of the use of two stages of filtration, the particles removed by secondary filter are essentially unused polishing sulfur sorbent 86 (i.e., copper oxide) and used sorbent (i.e., copper sulfide) that is free from contamination by coal ash and calcium based sorbent. Consequently, from the lock hopper 101, the solids are collected in hopper 102 and then removed for reprocessing—for example, in the regenerator 34.

As shown in FIG. 4, a standleg removes used polishing sulfur sorbent 87 particles (i.e., copper sulfide) from the polishing de-sulfurizer 33 and directs them, via an N-valve 88, into the regenerator 34. Pressurized air 29 is also introduced into the regenerator 34, along with particles 89 captured by cyclones 28' and 28" and introduced via an L-valve 50 supplied with pressurized air 90. The major reactions in the regenerator 34 are the conversion of the copper sulfide into copper and sulfur dioxide, and the oxidation of copper into fresh copper oxide sorbent:

$$CU+\frac{1}{2}O_2=CuO$$

$$Cu_2S+O_2=2\ Cu+SO_2.$$

Figure 10:
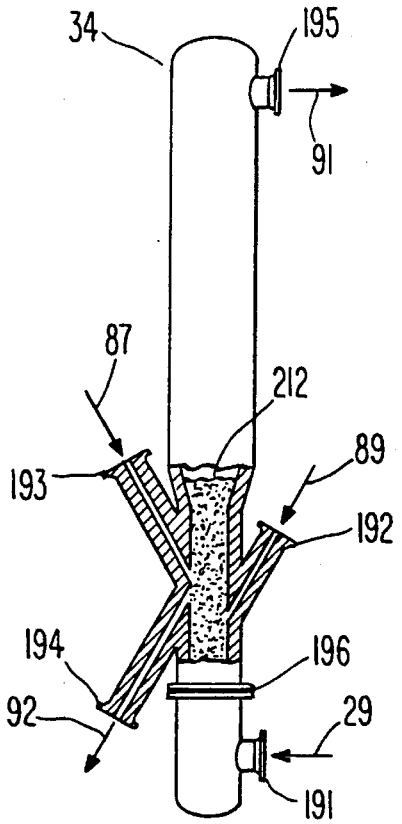
FIG. 10 is partial cross-section of the sorbent regenerator vessel shown in FIG. 2.

As shown in FIG. 10, the regenerator 34 is comprised of a refractory lined vessel 190 that encloses a slugging fluidized bed of used and unused sorbent particles fluidized by the pressurize air 29 and supported on a distribution plate 206. Under normal operating conditions, the bed is maintained at a temperature of approximately 870° C. (1600° F.) and pressure of approximately 1650 kPa (240 psia). The vessel 190 has an air inlet 191 for receiving the pressurized air 91, a solids inlet 193 for receiving the used sorbent 87 to be regenerated, a solids inlet 192 through which the particles 89 captured by the cyclones 28 and 28" are returned, a gas outlet 195 for discharging the sulfur dioxide 91 produced by the regeneration, and a solids outlet 194 for returning regenerated sorbent 92 to the polishing desulfurizer 33.

The sulfur dioxide gas 104 produced by the regeneration is cooled in a heat exchanger 94 to approximately 315° C. (600° F.) and de-pressurized prior to passing it through a conventional bag house filter 95. The sorbent 96 captured in the bag house is removed for reprocessing, while the clean sulfur dioxide rich gas stream 93 is directed to the oxidizer 26, along with air 78 and the used and unused sorbent 74 from the primary filter 25.

In the oxidizer 26, three processes occur—(i) sulfur dioxide in the gas stream 93 from the regenerator 34 is captured by the unused primary sulfur sorbent (i.e., $CaCO_3$) from the primary filter, (ii) used sorbent (i.e., CaS) from the primary filter is oxidized into a more stable compound (i.e., $CaSO_4$) for disposal, and (iii) carbon collected from the primary filter is oxidized to carbon dioxide. Thus, the primary reactions are:

$$CaCO_3=CaO+CO_2$$

$$CaO+SO_2+\frac{1}{2}O_2=CaSO_4$$

$$CaS+2O_2=CaSO_4$$

$$C+O_2=CO_2.$$

Thus, the oxidizer eliminates the need for an expensive process for converting the $SO_2$ rich gas from the regenerator into elemental sulfur or sulfuric acid by reacting it with the unused primary sulfur sorbent.

The solids 31 (i.e., calcium sulfate) removed from the oxidizer 26 are transported, via a conveyor 75, to a hopper 76 to await disposal. The gas 85 discharged from the oxidizer 26 passes through two cyclone separators 81' and 81", a heat exchanger 83 in which the gas is cooled to 315° C. (600° F.) and a conventional bag house filter 84. The gas 36 is then discharged to atmosphere through a stack. The solids 82 removed by the bag house filter 84 are cooled and stored for disposal, along with the solids 80 removed by the second cyclone 81". The solids 79 removed by the first cyclone 81' are returned to the oxidizer 26 via an L-valve 50 supplied with air 77.

Figure 11:
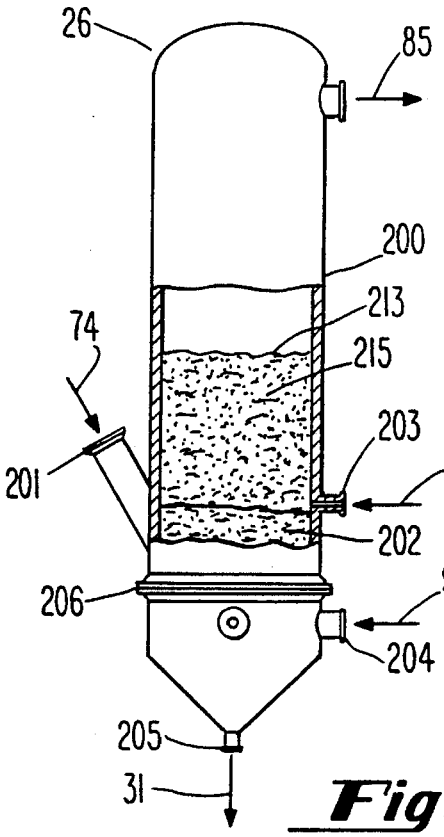
FIG. 11 is partial cross-section of the oxidizer vessel shown in FIG. 2.

The oxidizer 26 is essentially a two stage, circulating combustor in which both stages are operated at super-stoichiometric conditions. As shown in FIG. 11, the oxidizer 26 is comprised of a vessel 200 that encloses an atmospheric fluidized bed 213 of used and unused primary sorbent particles—i.e., primarily—70 mesh limestone that has been partially sulfided. The sulfur dioxide rich stream 93 from the regenerator 34 enters an inlet plenum via inlet 204 and is distributed by a bubble cap distribution plate 206—that is, the gas stream 93 is introduced below the distribution plate. This gas stream serves to fluidize the primary bed 202. The air 78 is injected above the distribution plate 206 by means of an inlet 203, fluidizing a second stage dilute bed 215. Under normal operating conditions, the bed is maintained at a temperature of approximately 870° C. (1600° F). The vessel 200 has a first solids inlet 201 for receiving the primary sorbent 74 from the primary filter, and a second solids inlet (not shown) through which the particles 79 captured by the cyclone separator 81' are returned.

Although the current invention has been illustrated with reference to fuel gas produced by a gasifier, the invention is equally applicable for cleaning the fuel gas produced in a direct coal-fired turbine. Moreover, although the invention has been disclosed as having both a primary and a polishing sulfur removal stage, the invention could also be practiced with only a single stage of sulfur removal, using only either the primary or polishing sorbent. Accordingly, the current invention may be embodied in other specific forms without departing from the spirit or essential attributes thereof and, accordingly, reference should be made to the appended claims, rather than to the foregoing specification, as indicating the scope of the invention.

I claim:

1. A system for removing sulfur species from a hot coal-derived gas, comprising:

a) first means for injecting a first sulfur sorbent into contact with said gas so as to entrain said first sorbent therein and convert said first sorbent into a first sulfur compound;

b) removing means for removing from said gas at least a portion of said entrained first sorbent and said first sulfur compound;

c) second means, connected to receive said gas from said removing means, for bringing a second sulfur sorbent into contact with said gas so as to convert a portion of said second sulfur sorbent into a second sulfur compound;

d) sorbent regenerating means connected to said second means for regenerating said second sulfur compound so as to produce said second sulfur sorbent and a sulfurous gas; and e) a vessel connected to receive said first sorbent and said first sulfur compound removed by said removing means and connected to receive said sulfurous gas produced in said sorbent regenerating means, said vessel enclosing a bed of said first sorbent and said first sulfur compound fluidized by said sulfurous gas.

2. The sulfur removal system according to claim 1, wherein said sorbent regenerating means comprises a vessel enclosing a fluidized bed of said second sulfur compound.

3. A system for removing sulfur species from a gas, comprising:

a) a first sorbent contact means for bringing a first sulfur sorbent into contact with said gas and for entraining said first sorbent therein, thereby removing a first portion of said sulfur species from said gas by converting said first sorbent into a first sulfur compound;

b) a first filter connected to receive said gas from said first sorbent contact means, said first filter having means for removing from said gas at least a portion of said first sorbent and said first sulfur compound;

c) second sorbent contact means for bringing a second sulfur sorbent into contact with said gas, thereby removing a second portion of said sulfur species from said gas and producing a second sulfur compound, said second sorbent contact means connected to receive said gas from said first filter;

d) a regenerator having means for regenerating said sulfur compound so as to produce regenerated second sulfur sorbent and a sulfurous gas, said regenerator connected to receive said second sulfur compound from said second sorbent contact means and connected to discharge said regenerated second sulfur sorbent to said second sorbent contact means; and e) means for converting said first sulfur compound removed by said first filter into a third sulfur compound, said third sulfur compound being more stable than said first sulfur compound, said converting means connected to receive said first sulfur compound from said first filter.

4. The sulfur removal system according to claim 3, wherein said converting means comprises an oxidizer, and wherein said first sulfur compound comprises calcium sulfide and said third sulfur compound comprises calcium sulfate.

5. A system for removing sulfur species from a gas, comprising:

a) a first sorbent contact means for bringing a first sulfur sorbent into contact with said gas and for entraining said first sorbent therein, thereby removing a first portion of said sulfur species from said gas by converting said first sorbent into a first sulfur compound;

b) a first filter connected to receive said gas from said first sorbent contact means, said first filter having means for removing from said gas at least a portion of said first sorbent and said first sulfur compound;

c) second sorbent contact means for bringing a second sulfur sorbent into contact with said gas, thereby removing a second portion of said sulfur species from said gas and producing a second sulfur compound, said second sorbent contact means connected to receive said gas from said first filter;

d) a regenerator having means for regenerating said sulfur compound so as to produce regenerated second sulfur sorbent and a sulfurous gas, said regenerator connected to receive said second sulfur compound from said second sorbent contact means and connected to discharge said regenerated second sulfur sorbent to said second sorbent contact means; and e) means for converting said sulfurous gas produced by said regenerator into a solid sulfur compound, said converting means connected to receive said sulfurous gas from said regenerator.

6. The sulfur removal system according to claim 5, wherein said converting means comprises a vessel enclosing a fluidized bed of said first sulfur sorbent removed by said first filter.

7. A system for removing sulfur species from a gas, comprising:

a) a first sorbent contact means for bringing a first sulfur sorbent into contact with said gas and for entraining said first sorbent therein, thereby removing a first portion of said sulfur species from said gas by converting said first sorbent into a first sulfur compound;

b) a first filter connected to receive said gas from said first sorbent contact means, said first filter having means for removing from said gas at least a portion of said first sorbent and said first sulfur compound;

c) second sorbent contact means for bringing a second sulfur sorbent into contact with said gas, thereby removing a second portion of said sulfur species from said gas and producing a second sulfur compound, said second sorbent contact means connected to receive said gas from said first filter;

d) a regenerator having means for regenerating said sulfur compound so as to produce regenerated second sulfur sorbent and a sulfurous gas, said regenerator connected to receive said second sulfur compound from said second sorbent contact means and connected to discharge said regenerated second sulfur sorbent to said second sorbent contact means; and e) means for converting said first sulfur compound into a third sulfur compound and for converting said sulfurous gas into a solid sulfur compound, said third sulfur compound being more stable than said first sulfur compound, said converting means connected to receive said first sulfur compound from said first filter and connected to receive said sulfurous gas from said regenerator.

8. The sulfur removal system according to claim 7, wherein said converting means comprises an oxidizer, and wherein said first sulfur compound comprises calcium sulfate, said third sulfur compound comprises calcium sulfate, said sulfurous gas comprises sulfur dioxide, and said solid sulfur compound comprises calcium sulfate.

9. The sulfur removal system according to claim 8, wherein said oxidizer comprises a vessel enclosing a fluidized bed of said first sorbent and said first sulfur compound.

10. A system for removing sulfur species from a gas, comprising:

a) a first sorbent contact means for bringing a first sulfur sorbent into contact with said gas and for entraining said first sorbent therein, thereby removing a first portion of said sulfur species from said gas by converting said first sorbent into a first sulfur compound;

b) a first filter connected to receive said gas from said first sorbent contact means, said first filter having means for removing from said gas at least a portion of said first sorbent and said first sulfur compound;

c) second sorbent contact means for bringing a second sulfur sorbent into contact with said gas, thereby removing a second portion of said sulfur species from said gas and producing a second sulfur compound, said second sorbent contact means connected to receive said gas from said first filter;

d) a regenerator having means for regenerating said sulfur compound so as to produce regenerated second sulfur sorbent and a sulfurous gas, said regenerator connected to receive said second sulfur compound from said second sorbent contact means and connected to discharge said regenerated second sulfur sorbent to said second sorbent contact means; and e) means for converting said first sulfur compound removed by said first filter into a third sulfur compound, said third sulfur compound being more stable than said first sulfur compound, said converting means connected to receive said first sulfur compound from said first filter;

f) wherein said converting means comprises a vessel enclosing a fluidized bed of said first sulfur compound.

* * * * *